US010446945B2

(12) United States Patent
Wu et al.

(10) Patent No.: US 10,446,945 B2
(45) Date of Patent: Oct. 15, 2019

(54) METAL LEAF SPRING STRUCTURE OF ELECTRICAL CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chang Han Lee, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/985,842

(22) Filed: May 22, 2018

(65) Prior Publication Data

US 2018/0342815 A1 Nov. 29, 2018

(30) Foreign Application Priority Data

May 26, 2017 (TW) ..... 106207568 U

(51) Int. Cl.
*H01R 4/48* (2006.01)
*H01R 12/51* (2011.01)

(52) U.S. Cl.
CPC ..... *H01R 4/4809* (2013.01); *H01R 4/48* (2013.01); *H01R 4/4827* (2013.01); *H01R 4/4845* (2013.01); *H01R 12/515* (2013.01)

(58) Field of Classification Search
CPC ..... H01R 4/28; H01R 4/48; H01R 4/4809; H01R 4/4818; H01R 4/4845; H01R 12/515
See application file for complete search history.

(56) References Cited

U.S. PATENT DOCUMENTS

| | | | | |
|---|---|---|---|---|
| 6,716,070 | B2 * | 4/2004 | Christensson | A61N 1/02 439/729 |
| 10,003,142 | B1 * | 6/2018 | Lin | H01R 4/4836 |
| 2018/0342816 | A1 * | 11/2018 | Wu | H01R 4/4818 |
| 2018/0342817 | A1 * | 11/2018 | Wu | H01R 4/4818 |

* cited by examiner

*Primary Examiner* — Vanessa Girardi
(74) *Attorney, Agent, or Firm* — Rosenberg, Klein & Lee

(57) ABSTRACT

A metal leaf spring structure of electrical connection terminal includes a main body. The main body has a base section defined with a first end and a second end. The first end is connected with a first section and a locating section. The second end is connected with a bight section and a reciprocally movable second section. The locating section has a head section and a tail section. The locating section is positioned in the reciprocally moving path of the second section to setup a moving endpoint of the second section. The metal leaf spring structure of electrical connection terminal improves the shortcomings of the conventional metal leaf spring that the conductive wire cannot be plugged into the terminal by a precise angle so that the metal leaf spring is over-bent to affect the pressing and securing effect.

31 Claims, 5 Drawing Sheets

METAL LEAF SPRING STRUCTURE OF ELECTRICAL CONNECTION TERMINAL

BACKGROUND OF THE INVENTION

1. Field of the Invention

The present invention relates generally to a metal leaf spring structure of electrical connection terminal, and more particularly to an assembly of a terminal device for an electro-conductive wire to plug in and connect therewith and a metal leaf spring for pressing or releasing the electro-conductive wire.

2. Description of the Related Art

A conventional terminal device or wire pressing terminal has an insulation case (generally made of plastic material) and an electrical connector or metal member (or metal leaf spring). The metal leaf spring is enclosed in the insulation case to press and electrically connect with or release a conductive wire plugged into the terminal device.

Such electrical connection terminal devices include two types. The first type of electrical connection terminal device is inserted on a circuit board such as printed circuit board (PCB). The second type of electrical connection terminal device is latched with a grounding rail (or conductive rail) in a row to set up a common grounding device of an electrical apparatus or mechanical equipment.

The aforesaid electrical connection terminal is inserted on a circuit board such as printed circuit board (PCB) or a grounding rail and includes an insulation case having a perforation or a wire plug-in hole for the conductive wire to plug into the interior of the case. The case defines a chamber in which the electrical connector (or the metal leaf spring) is mounted. The metal leaf spring serves to contact or electrically connect with the conductive wire plugged into the case. The electrical connector has an elastic free end. After the conductive wire is plugged into the case, the free end of the electrical connector will bite the conductive wire to prevent the conductive wire from easily detaching from the electrical connector out of contact with the electrical connector. Unless an operator uses a tool to extend into the case and push/press the free end, the conductive wire cannot be released from the contact of the electrical connector.

The metal leaf spring of the conventional electrical connection terminal device has some shortcomings in structural design and application. For example, when plugging the conductive wire into the terminal device, due to human operation factor, it often takes place that the conductive wire cannot enter the terminal device by a precise angle to push/press the free end of the metal leaf spring. In this case, the elastic free end of the metal leaf spring can hardly securely press and restrict the conductive wire or the metal leaf spring will be over-bent. Especially, after a long period of high-frequency assembling operation of the conductive wire, elastic fatigue is apt to happen to the structure of the metal leaf spring. As a result, the lifetime of the terminal device will be shortened.

In order to improve the shortcoming of the metal leaf spring that elastic fatigue is apt to happen to the structure of the metal leaf spring to shorten the lifetime of the terminal device, a technical means for preventing the metal leaf spring from being over-bent has been disclosed.

The conventional clamping spring (or metal leaf spring) is assembled with a reception member (or frame body). A protrusion section is formed on one side of the reception member in the moving path of the clamping leg (or free end) of the clamping spring to prevent the clamping leg from being over-biased.

However, as well known by those who are skilled in this field, the structure of the additional protrusion section of the reception member (or frame body) in cooperation with the clamping spring (or metal leaf spring) is relatively complicated. In addition, when the conductive wire is plugged into the electrical connection terminal by an imprecise angle, the conductive wire also will push/press the clamping leg of the clamping spring to deflect the clamping leg and make the clamping leg pass over the protrusion section. This deteriorates the effect that the protrusion section prevents the clamping leg from being over-biased. This is not what we expect.

To speak representatively, the above references reveal some shortcomings existing in the conventional electrical connection terminal and the metal leaf spring in design of relevant assembling structure. In case the assembling structure of the terminal device and the metal leaf spring is redesigned to be different from the conventional electrical connection terminal, the use form of the electrical connection terminal can be changed to practically improve the application of the electrical connection terminal and enhance the operation stability of the electrical connection terminal.

It is found that the structural form of an optimal terminal device or metal leaf spring must overcome or improve the aforesaid shortcomings of the conventional electrical connection terminal and include several design considerations as follows:

1. The structural form of the conventional electrical connection terminal that the reception member (or frame body) is additionally formed with the protrusion section must be omitted so as to improve the shortcomings existing in the conventional electrical connection terminal that the cooperative structure is relatively complicated (and/or the manufacturing cost is relatively high) and the clamping leg (or the free end of the metal leaf spring) is apt to deflect and pass over the protrusion section to deteriorate the effect that the protrusion section prevents the clamping leg from being over-biased.
2. In the condition that the metal leaf spring can keep stably pressing and restricting the conductive wire, a true moving range of the metal leaf spring (or the free end thereof) is set up. Especially, the metal leaf spring itself forms an end position, whereby the free end can only move to reach the set end position, that is, the metal leaf spring itself can stop the free end. Therefore, no matter how the free end moves, the free end cannot pass over the metal leaf spring so that the free end is prevented from being over-biased. In this case, the possibility that the metal leaf spring is over-bent to shorten the lifetime of the electrical connection terminal as in the conventional structure is minimized.

SUMMARY OF THE INVENTION

It is therefore a primary object of the present invention to provide a metal leaf spring structure of electrical connection terminal. The metal leaf spring structure includes a main body. The main body has a base section defined with a first end and a second end. The first end is connected with a first section and a locating section. The second end is connected with a bight section and a reciprocally movable second section. The locating section has a head section and a tail section connected with the head section. The locating section is positioned in the reciprocally moving path of the second section to set up a moving end point of the second section. The metal leaf spring structure of electrical connection terminal improves the shortcomings of the conventional metal leaf spring that the conductive wire cannot be plugged into the terminal by a precise angle so that the metal leaf spring is over-bent to affect the pressing and securing effect.

In the above metal leaf spring structure of electrical connection terminal, a bent section is formed between the first end of the base section and the first section. The bent section contains an angle. The first section is bent toward the second end of the base section and obliquely extends to connect with the locating section, whereby a subsidiary bent section is formed between the first section and the locating section. The subsidiary bent section contains an angle. The bight section between the second end and the second section of the base section contains an angle, whereby the second section obliquely extends in a direction to the first end of the base section. The tail section is bent toward the base section and extends to contact the base section to form a locating section structure so as to support and secure the locating section and prevent the second section from being over-biased.

The present invention can be best understood through the following description and accompanying drawings, wherein:

DETAILED DESCRIPTION OF THE PREFERRED EMBODIMENTS

Figure 2:
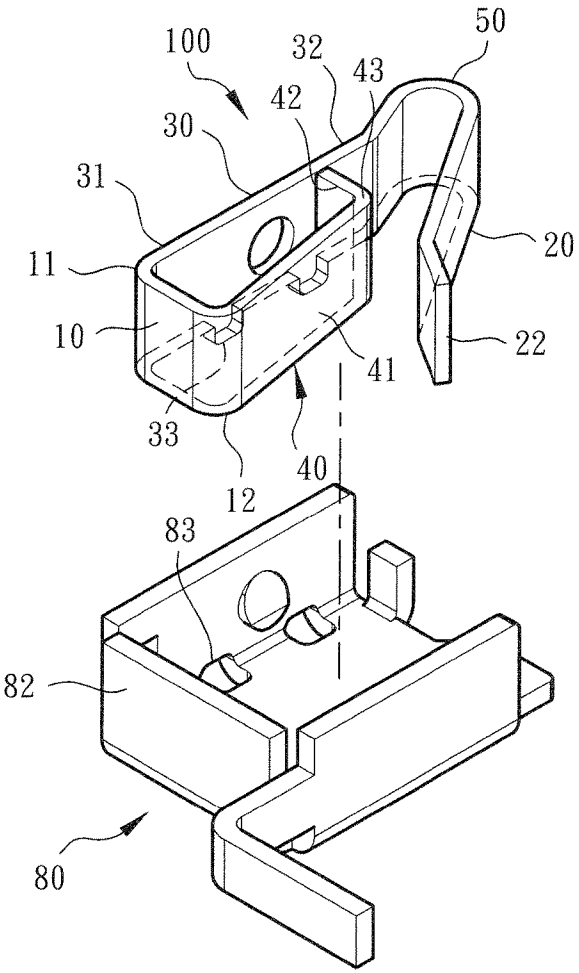
FIG. 2 is a perspective exploded view according to FIG. 1.
Figure 1:
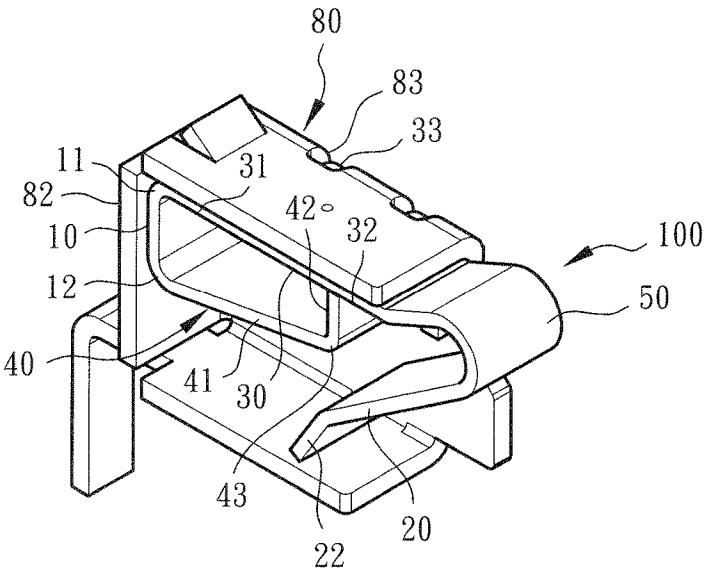
FIG. 1 is a perspective assembled view of the present invention and the electrical connection member, showing that the electrical connection member is formed as a frame body.
Figure 3:
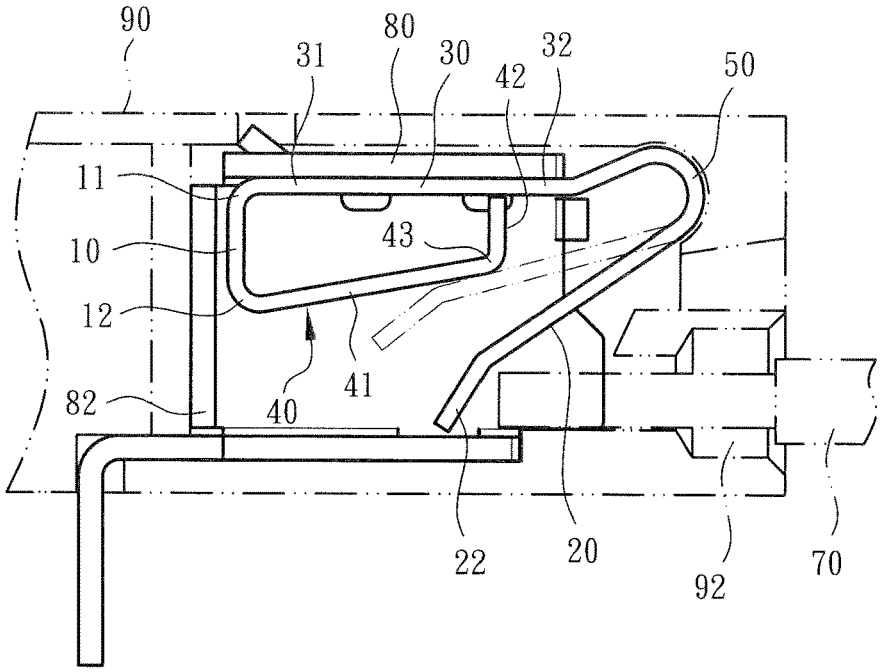
FIG. 3 is a view showing the operation of the metal leaf spring of FIG. 1, in which the phantom lines show that the conductive wire is plugged into the case to bias the second section of the main body.

Please refer to FIGS. 1, 2 and 3. The metal leaf spring structure of electrical connection terminal of the present invention includes a main body 100. The main body 100 is selectively made of elastic metal sheet or the like material by means of pressing in the form of a plate body. The main body 100 is mounted on a case 90 made of insulation material. Alternatively, the main body 100 is assembled with an electrical connection member 80 in the form of a frame body structure and the main body 100 and the electrical connection member 80 are together assembled and mounted on the case 90.

As shown in the drawings, the main body 100 includes a base section 30 defined with a first end 31 and a second end 32. The first end 31 is connected with a first section 10 and a locating section 40. The second end 32 is connected with a bight section 50 and a reciprocally movable second section 20. The locating section 40 has a head section 41 and a tail section 42 connected with the head section 41. The locating section 40 is positioned in a reciprocally moving path of the second section 20 to set up a moving end point or moving range of the second section 20.

To speak more specifically, a bent section 11 is formed between the first end 31 of the base section and the first section 10. The bent section 11 contains an angle, which is an acute angle, a right angle or an obtuse angle. In addition, the first section 31 is bent toward the second end 32 of the base section and extends to connect with the locating section 40, whereby a subsidiary bent section 12 is formed between the first section 10 and the locating section 40. The subsidiary bent section 12 contains an angle, which is an acute angle, a right angle or an obtuse angle.

As shown in FIG. 3, the locating section 40 obliquely extends in a direction to the upper side of the drawing, whereby the angle contained between the first section 10 and the locating section 40 (or the subsidiary bent section 12) is an acute angle. The second section 20 obliquely extends in a direction to the lower side of the drawing, whereby the angle contained between the second section 20 and the base section 30 is an acute angle.

In a preferred embodiment, the tail section 42 of the locating section 40 of the main body is bent toward the base section 30 to form a sub-bent section 43, whereby the tail section 42 is in contact with the base section 30 to form a locating section structure so as to set up a locating support point for ensuring that the locating section 40 prevents the second section 20 from being over-biased.

As shown in FIGS. 1, 2 and 3, the sub-bent section 43 contains an angle, which is an acute angle, a right angle or an obtuse angle. In addition, the bight section 50 between the second end 32 and the second section 20 of the base section contains an angle, whereby the second section 20 extends in a direction to the first end 31 of the base section. At this time, it is defined that the second section 20 is positioned in an initial position.

As shown in FIGS. 1 and 2, the lateral side of the base section 30 is formed with finger sections 33 and the electrical connection member 80 is formed with mouth sections 83. The finger sections 33 can be inserted in the mouth sections 83 to securely assemble the main body 100 with the electrical connection member 80 with the second section 20 freely reciprocally movable.

As shown in FIG. 3, the case 90 has a wire plug-in hole 92. The conductive wire 70 can be plugged through the wire plug-in hole 92 into the case 90 to be pressed and restricted by the main body 100 and electrically connected with the electrical connection member 80.

To speak more specifically, when an operator plugs the conductive wire 70 through the wire plug-in hole 92 into the case 90 to electrically connect with the electrical connection member 80, the conductive wire 70 pushes the second section 20 to move in a direction to the locating section 40. Also, in cooperation with the structure of the bight section 50, the second section 20 or the tail end 22 of the second section 20 swings toward the lower side of the drawing to securely press and restrict the conductive wire 70 entering the case 90 or the electrical connection member 80.

It should be noted that the locating section 40 of the main body 100 serves as a moving end point structure of the second section 20. This ensures that when the second section 20 is pushed/pressed and biased by the conductive wire 70, the second section 20 is prevented from being over-biased as the clamping leg of the conventional terminal that passes over the stop point (or the protrusion section). In addition, the locating section 40 has the form of an (entirely) plane structure, whereby the second section 20 can snugly attach to the locating section 40 without deflecting.

Figure 4:
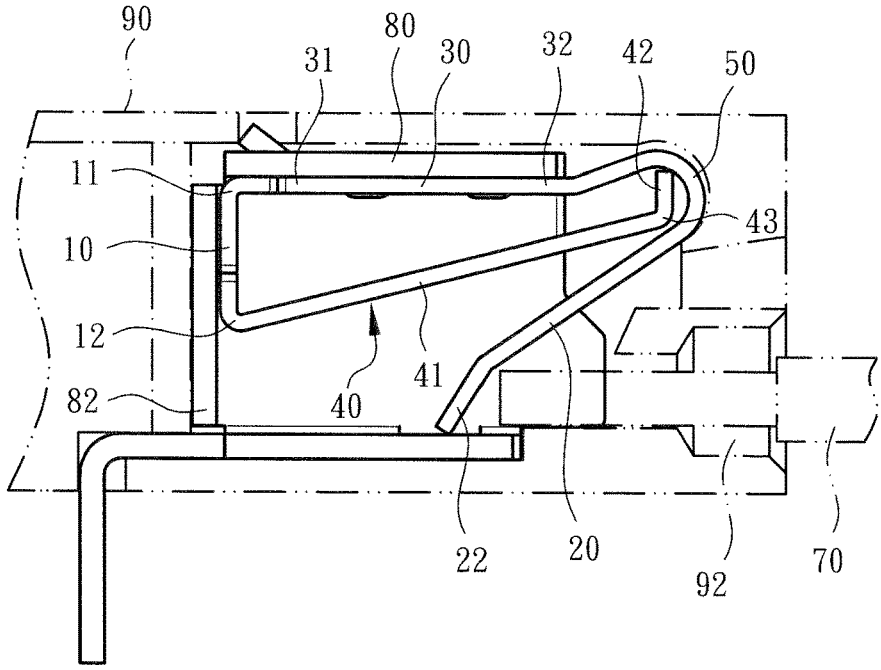
FIG. 4 is a view of a preferred embodiment of the present invention, showing the structure of the locating section extending to the bight section.

Please now refer to FIG. 4, which shows a modified embodiment of the main body 100 of the present invention. In this embodiment, the head section 41 of the locating section 40 of the main body extends in a direction to the bight section 50, whereby the tail section 42 extends to a position of the bight section 50. The tail section 42 is bent toward the base section 30 to form a sub-bent section 43 and the tail section 42 is in contact with the bight section 50 to set up a locating support point for ensuring that the locating section 40 prevents the second section 20 from being over-biased.

Therefore, when the conductive wire 70 pushes the second section 20 to move toward the locating section 40, in case the second section 20 reaches or contacts the tail section 42 or the sub-bent section 43, the tail section 42 or the sub-bent section 43 can prevent the second section 20 from being over-biased.

FIG. 4 also shows a preferred embodiment in which the first section 10 is attached to the sidewall 82 of the electrical connection member 80, whereby the electrical connection member 80 provides a support effect for the main body 100 so that the main body 100 and the electrical connect ion member 80 can be more securely assembled with each other.

Figure 5:
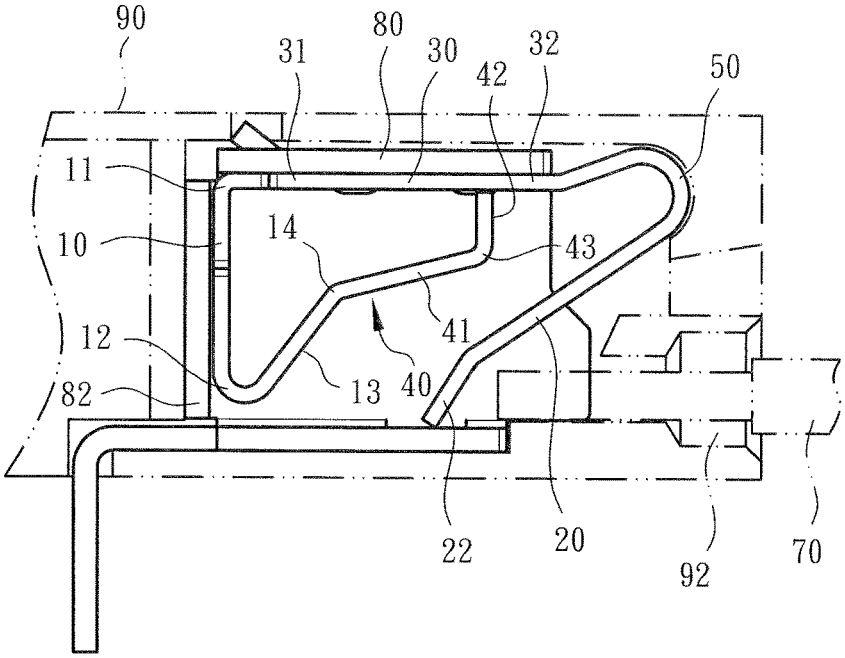
FIG. 5 is a view of a modified embodiment of the present invention, showing the structure of the subsidiary bent section between the first section and the locating section.

Please now refer to FIG. 5, which shows a modified embodiment of the main body 100 of the present invention. In this embodiment, a connection section 13 is disposed between the subsidiary bent section 12 and the locating section 40.

To speak more specifically, the connection section 13 obliquely extends in a direction to the base section 30 and the second end 32 to form a reverse bent section 14 connected with the locating section 40 (or the head section 41). As shown in the drawing, the angle contained between the first section 10 and the connection section 13 (or the subsidiary bent section 12) is an acute angle smaller than the obtuse angle contained between the connection section 13 and the locating section 40 (or the reverse bent section 14).

Figure 6:
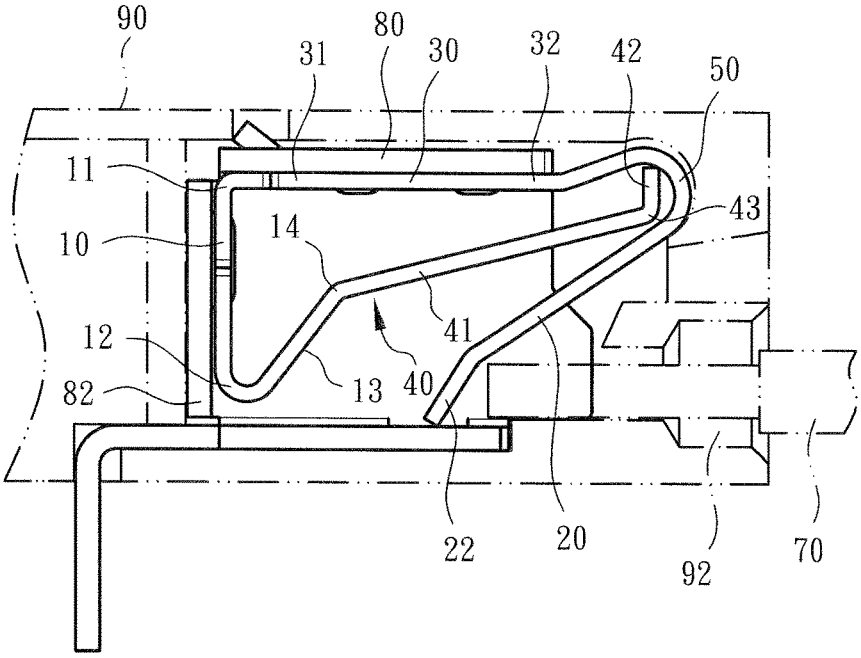
FIG. 6 is a view of a preferred embodiment of the present invention, showing the structures of the subsidiary bent section between the first section and the locating section and the tail section.

Please refer to FIG. 6, which shows the structures of the subsidiary bent section 12 between the first section 10 and the locating section 40, the connection section 13 and the tail section 42 of the main body. The head section 41 of the locating section 40 of the main body extends in a direction to the bight section 50, whereby the tail section 42 extends to a position of the bight section 50. The tail section 42 is bent toward the base section 30 to form a sub-bent section 43 and the tail section 42 is in contact with the bight section 50.

It should be noted that the structural form of the first section 10, the subsidiary bent section 12 and the connection section 13 as shown in FIGS. 5 and 6 increases the length of the first section 10. Correspondingly, the attachment length or area of the first section 10 to the sidewall 82 of the electrical connection member is increased so that the electrical connection member 80 can provide greater support effect for the main body 100 and the main body 100 and the electrical connection member 80 can be more securely assembled with each other.

Figure 7:
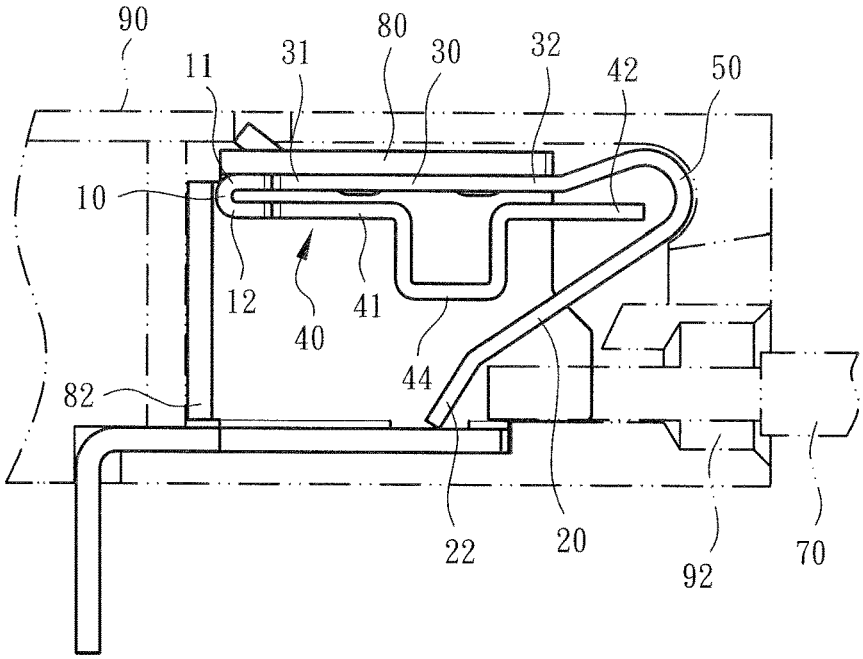
FIG. 7 is a view of a modified embodiment of the present invention, showing the structure of the head section of the locating section.

Please now refer to FIG. 7, which shows a modified embodiment of the main body 100 of the present invention. In this embodiment, the length of the first section 10 is as minimized as possible. Also, through the subsidiary bent section 12, the first section 10 is bent toward the second end 32 of the base section and extends to form the locating section 40. In addition, the locating section 40 is parallel to the base section 30.

As shown in the drawing, the tail section 42 of the locating section 40 extends to a position close to the bight section 50 and the head section 41 is formed with a U-shaped structure 44 in a direction reverse to the base section 30 (or to the lower side of the drawing). In cooperation with the head section 41 and the tail section 42 of the locating section 40 in contact with or parallel to the base section 30, the U-shaped structure 44 sets up a locating support point for preventing the second section 20 from being over-biased.

Figure 8:
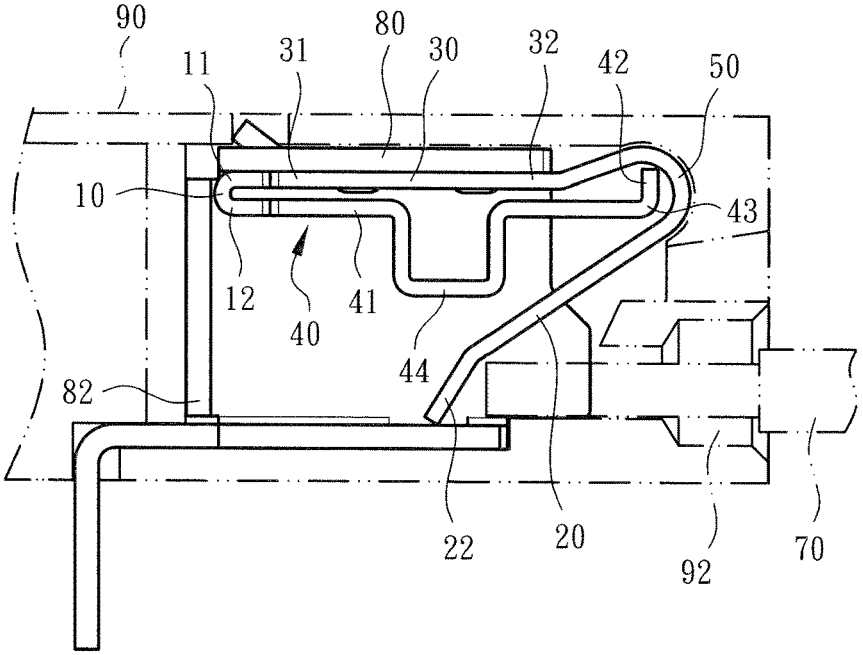
FIG. 8 is a view of a modified embodiment of the present invention, showing the structures of the head section and the tail section of the locating section.

FIG. 8 shows the structures of the subsidiary bent section 12 between the first section 10 and the locating section 40 of the main body and the head section 41 and the tail section 42 of the locating section 40. As shown in the drawing, the length of the first section 10 is as minimized as possible. Also, through the subsidiary bent section 12, the first section 10 is bent toward the second end 32 of the base section and extends to form the locating section 40. In addition, the locating section 40 is parallel to the base section 30.

FIG. 8 also shows that the tail section 42 of the locating section 40 extends to a position of the bight section 50. The tail section 42 is bent toward the base section 30 to form a sub-bent section 43 and the tail section 42 is in contact with the bight section 50. The head section 41 is formed with a U-shaped structure 44 in a direction reverse to the base section 30 (or to the lower side of the drawing). In cooperation with the head sect ion 41 of the locating section 40 in contact with or parallel to the base section 30 and the tail section 42 in contact with the bight section 50, the sub-bent section 43 and/or the U-shaped structure 44 respectively set up a locating support point for preventing the second section 20 from being over-biased.

Figure 9:
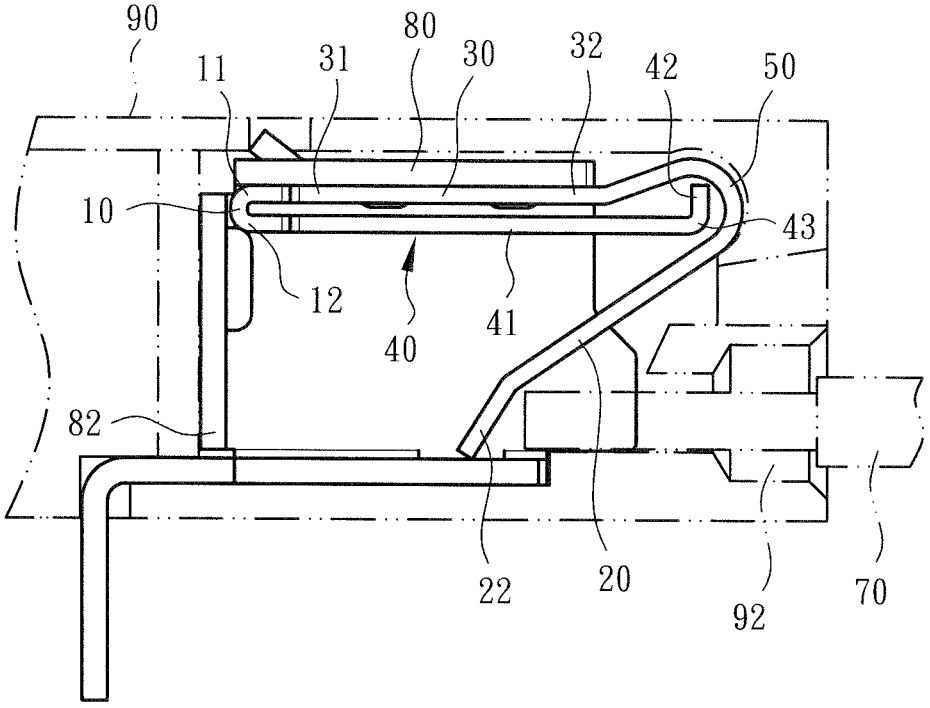
FIG. 9 is a view of a modified embodiment of the present invention, showing the structure of the base section and the locating section.

FIG. 9 shows a modified embodiment of the main body 100. As shown in the drawing, the length of the first section 10 is as minimized as possible. Also, through the subsidiary bent section 12, the first section 10 is bent toward the second end 32 of the base section and extends to form the locating section 40. In addition, the locating section 40 is parallel to the base section 30.

FIG. 9 also shows that the tail section 42 of the locating section 40 extends to a position of the bight section 50 to form a sub-bent section 43 and the tail section 42 is in contact with the bight section 50.

To speak representatively, in condition of optimal and stable operation, in comparison with the conventional electrical connection terminal, the metal leaf spring structure of electrical connection terminal of the present invention has the following advantages:

1. The main body 100 and the electrical connection terminal device or the relevant connection components thereof have been redesigned in use, structure and connection relationship. For example, the bent section 11 is formed between the base section 30 and the first section 10 of the main body and the subsidiary bent section 12 is formed between the first section 10 and the locating section 40. The head section 41 of the locating section 40 is formed with a U-shaped structure 44. The tail section 42 of the locating section 40 is bent toward the base section 30 to form the sub-bent section 43 or extends to a position of the bight section 50 so as to set up a locating support point. The structure of the present invention is obviously different from the conventional electrical connection terminal. Also, the present invention changes the use form of the conventional electrical connection terminal.

2. In the structural form of the main body 100, the structure of the cooperative protrusion section additionally formed on the reception member (or frame body) of the conventional electrical connection terminal is removed. Accordingly, the present invention improves the shortcoming of the conventional electrical connection terminal that the cooperative structure is relatively complicated and the clamping leg (or the free end of the metal leaf spring) is apt to deflect and pass over the protrusion section to deteriorate the effect that the protrusion section prevents the clamping leg from being over-biased.
3. In the condition that the metal leaf spring can keep stably pressing and restricting the conductive wire, a true moving range of the main body 100 (or the second section 20 thereof) is set up. Especially, the locating section 40 of the main body 100 itself forms a preset end position, which is formed by means of directly pressing the main body 100. In contrast, in the conventional electrical connection terminal, it is necessary to additionally dispose a cooperative component or stop component. The present invention obviously can lower the manufacturing cost. Furthermore, the second section 20 can only move to reach the set end position, where the main body 100 and/or the locating section 40 can stop the second section 20. Therefore, no matter how the second section 20 moves (or deflects), the free end of the second section 20 cannot pass over the main body 100 so that the free end is prevented from being over-biased. In this case, the possibility that the metal leaf spring is over-bent to shorten the lifetime of the electrical connection terminal as in the conventional structure is minimized.

In conclusion, the metal leaf spring structure of electrical connection terminal of the present invention is different from the conventional electrical connection terminal in space form and is advantageous over the conventional electrical connection terminal. The metal leaf spring structure of electrical connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A metal leaf spring structure of electrical connection terminal, comprising a main body, the main body having a base section defined with a first end and a second end, the first end being connected with a first section and a locating section, the locating section of the main body having the form of a plane structure, the second end of the main body being connected with a bight section and a reciprocally movable second section, a bent section being formed between the first end of the base section and the first section, the bent section containing an angle, the first section being bent toward the second end of the base section and extending to connect with the locating section, whereby a subsidiary bent section is formed between the first section and the locating section, the subsidiary bent section containing an angle, the locating section having a head section and a tail section connected with the head section, the tail section being bent toward the base section to form a sub-bent section, whereby the tail section is in contact with the base section, the bight section being between the second end and the second section of the base section containing an angle, whereby the second section obliquely extends in a direction to the first end of the base section, the locating section being positioned in a reciprocally moving path of the second section to set up a moving end point of the second section.

2. The metal leaf spring structure of electrical connection terminal as claimed in claim 1, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

3. The metal leaf spring structure of electrical connection terminal as claimed in claim 1, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

4. The metal leaf spring structure of electrical connection terminal as claimed in claim 1, wherein the angle contained by the bent section is selected from a group consisting of an acute angle, a right angle and an obtuse angle and the angle contained by the subsidiary bent section is selected from a group consisting of an acute angle, a right angle and an obtuse angle.

5. The metal leaf spring structure of electrical connection terminal as claimed in claim 4, wherein the locating section of the main body has the form of a plane structure, the tail section of the locating section being bent toward the base section to form a sub-bent section, whereby the tail section is in contact with the base section.

6. The metal leaf spring structure of electrical connection terminal as claimed in claim 4, wherein the tail section of the locating section of the main body extends to a position of the bight section, the tail section being bent toward the base section to form a sub-bent section and the tail section being in contact with the bight section.

7. The metal leaf spring structure of electrical connection terminal as claimed in claim 4, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

8. The metal leaf spring structure of electrical connection terminal as claimed in claim 1, wherein the main body is mounted on a case or an electrical connection member.

9. The metal leaf spring structure of electrical connection terminal as claimed in claim 8, wherein the locating section of the main body has the form of a plane structure, the tail section of the locating section being bent toward the base section to form a sub-bent section, whereby the tail section is in contact with the base section.

10. The metal leaf spring structure of electrical connection terminal as claimed in claim 8, wherein the tail section of the locating section of the main body extends to a position of the bight section, the tail section being bent toward the base section to form a sub-bent section and the tail section being in contact with the bight section.

11. The metal leaf spring structure of electrical connection terminal as claimed in claim 8, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

12. The metal leaf spring structure of electrical connection terminal as claimed in claim 8, wherein the locating section is parallel to the base section and the head section is formed with a U-shaped structure in a direction reverse to the base section.

13. The metal leaf spring structure of electrical connection terminal as claimed in claim 8, wherein the angle contained by the bent section is selected from a group consisting of an acute angle, a right angle and an obtuse angle and the angle contained by the subsidiary bent section is selected from a group consisting of an acute angle, a right angle and an obtuse angle.

14. The metal leaf spring structure of electrical connection terminal as claimed in claim 13, wherein the locating section of the main body has the form of a plane structure, the tail section of the locating section being bent toward the base section to form a sub-bent section, whereby the tail section is in contact with the base section.

15. The metal leaf spring structure of electrical connection terminal as claimed in claim 13, wherein the tail section of the locating section of the main body extends to a position of the bight section, the tail section being bent toward the base section to form a sub-bent section and the tail section being in contact with the bight section.

16. The metal leaf spring structure of electrical connection terminal as claimed in claim 13, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

17. The metal leaf spring structure of electrical connection terminal as claimed in claim 8, wherein a lateral side of the base section is formed with finger sections and the electrical connection member is formed with mouth sections, the finger sections being inserted in the mouth sections to securely assemble the main body with the electrical connection member, the first section being attached to a sidewall of the electrical connection member.

18. The metal leaf spring structure of electrical connection terminal as claimed in claim 17, wherein the locating section of the main body has the form of a plane structure, the tail section of the locating section being bent toward the base section to form a sub-bent section, whereby the tail section is in contact with the base section.

19. The metal leaf spring structure of electrical connection terminal as claimed in claim 17, wherein the tail section of the locating section of the main body extends to a position of the bight section, the tail section being bent toward the base section to form a sub-bent section and the tail section being in contact with the bight section.

20. The metal leaf spring structure of electrical connection terminal as claimed in claim 17, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

21. The metal leaf spring structure of electrical connection terminal as claimed in claim 17, wherein the locating section is parallel to the base section and the head section is formed with a U-shaped structure in a direction reverse to the base section.

22. The metal leaf spring structure of electrical connection terminal as claimed in claim 17, wherein the angle contained by the bent section is selected from a group consisting of an acute angle, a right angle and an obtuse angle and the angle contained by the subsidiary bent section is selected from a group consisting of an acute angle, a right angle and an obtuse angle.

23. The metal leaf spring structure of electrical connection terminal as claimed in claim 22, wherein the locating section of the main body has the form of a plane structure, the tail section of the locating section being bent toward the base section to form a sub-bent section, whereby the tail section is in contact with the base section.

24. The metal leaf spring structure of electrical connection terminal as claimed in claim 22, wherein the tail section of the locating section of the main body extends to a position of the bight section, the tail section being bent toward the base section to form a sub-bent section and the tail section being in contact with the bight section.

25. The metal leaf spring structure of electrical connection terminal as claimed in claim 22, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

26. A metal leaf spring structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the first section being bent toward the second end of the base section and extending to connect with the locating section, whereby a subsidiary bent section is formed between the first section and the locating section, the subsidiary bent section containing an angle, the locating section having a head section and a tail section connected with the head section, the bight section being between the second end and the second section of the base section containing an angle, the tail section of the locating section of the main body extending to a position of the bight section, the tail section being bent toward the base section to form a sub-bent section and the tail section being in contact with the bight section, whereby the second section obliquely extends in a direction to the first end of the base section, the locating section being positioned in a reciprocally moving path of the second section to set up a moving end point of the second section.

27. The metal leaf spring structure of electrical connection terminal as claimed in claim 26, wherein the locating section is parallel to the base section and the head section is formed with a U-shaped structure in a direction reverse to the base section.

28. The metal leaf spring structure of electrical connection terminal as claimed in claim 26, wherein the locating section is parallel to the base section.

29. The metal leaf spring structure of electrical connection terminal as claimed in claim 26, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

30. The metal leaf spring structure of electrical connection terminal as claimed in claim 29, wherein the locating section is parallel to the base section and the head section is formed with a U-shaped structure in a direction reverse to the base section.

31. The metal leaf spring structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the first section being bent toward the second end of the base section and extending to connect with the locating section, whereby a subsidiary bent section is formed between the first section and the locating section, the subsidiary bent section containing an angle, the locating section having a head section and a tail section connected with the head section, the locating section being parallel to the base section and the head section being formed with a U-shaped structure in a direction reverse to the base section, the bight section being between the second end and the second section of the base section containing an angle, whereby the second section obliquely extends in a direction to the first end of the base section, the locating section being positioned in a reciprocally moving path of the second section to set up a moving end point of the second section.

* * * * *